US008016208B2

(12) United States Patent
Babaev

(10) Patent No.: US 8,016,208 B2
(45) **Date of Patent: *Sep. 13, 2011**

(54) ECHOING ULTRASOUND ATOMIZATION AND MIXING SYSTEM

(75) Inventor: Eilaz Babaev, Minnetonka, MN (US)

(73) Assignee: Bacoustics, LLC, Minnetonka, MN (US)

( * ) Notice: Subject to any disclaimer, the term of this patent is extended or adjusted under 35 U.S.C. 154(b) by 112 days.

This patent is subject to a terminal disclaimer.

(21) Appl. No.: 12/028,154

(22) Filed: Feb. 8, 2008

(65) Prior Publication Data

US 2009/0200394 A1 Aug. 13, 2009

(51) Int. Cl.
*B05B 3/04* (2006.01)
*F17D 1/16* (2006.01)
*F17D 1/18* (2006.01)

(52) U.S. Cl. ..... 239/102.1; 239/102.2; 239/4; 239/1; 137/13; 137/827

(58) Field of Classification Search ..... 239/1, 4, 239/102.1, 102.2
See application file for complete search history.

(56) References Cited

U.S. PATENT DOCUMENTS 3,145,931 A * 8/1964 Cleall ..... 239/102.2
3,243,122 A * 3/1966 Snaper ..... 239/102.2
3,373,752 A * 3/1968 Inoue ..... 134/1
3,970,250 A 7/1976 Drews
4,153,201 A 5/1979 Berger et al.
4,402,458 A 9/1983 Lierke et al.
4,655,393 A 4/1987 Berger
4,684,328 A 8/1987 Murphy
4,715,353 A 12/1987 Koike et al.
4,726,522 A * 2/1988 Kokubo et al. ..... 239/102.2
4,726,524 A * 2/1988 Ishikawa et al. ..... 239/102.2
4,739,762 A 4/1988 Palmaz
4,850,534 A 7/1989 Takahashi et al.
5,076,266 A 12/1991 Babaev
5,119,775 A 6/1992 Kokubo et al.
5,133,732 A 7/1992 Wiktor
5,154,347 A * 10/1992 Vijay ..... 239/4
5,179,923 A 1/1993 Tsurutani et al.
5,292,331 A 3/1994 Boneau
5,336,534 A 8/1994 Nakajima et al.
5,409,163 A 4/1995 Erickson et al.
5,516,043 A 5/1996 Manna
5,540,384 A 7/1996 Erickson et al.
5,582,348 A 12/1996 Erickson et al.
(Continued)

FOREIGN PATENT DOCUMENTS

EP 424532 A4 12/1991
(Continued)

*Primary Examiner* — Len Tran
*Assistant Examiner* — James Hogan

(57) ABSTRACT

An ultrasound apparatus capable of mixing and/or atomizing fluids is disclosed. The apparatus includes a horn having an internal chamber through which fluids to be atomized and/or mixed flow. Connected to the horn's proximal end, a transducer powered by a generator induces ultrasonic vibrations within the horn. Traveling down the horn from the transducer, the ultrasonic vibrations induce the release of ultrasonic energy into the fluids to be atomized and/or mixed as they travel through the horn's internal chamber. As the ultrasonic vibrations travel through the chamber, the fluids within the chamber are agitated and/or begin to cavitate, thereby mixing the fluids. Upon reaching the front wall of the chamber, the ultrasonic vibrations are reflected back into the chamber, like an echo. The ultrasonic vibrations echoing off the front wall pass through the fluids within the chamber a second time, further mixing the fluids.

25 Claims, 3 Drawing Sheets

U.S. PATENT DOCUMENTS 5,597,292 A 1/1997 Rhee et al.
5,611,993 A 3/1997 Babaev
5,685,485 A * 11/1997 Mock et al. ..... 239/102.2
5,803,106 A 9/1998 Cohen et al.
5,868,153 A 2/1999 Cohen et al.
5,891,507 A 4/1999 Jayaraman
5,922,247 A 7/1999 Shoham et al.
5,970,974 A 10/1999 Van Der Linden et al.
5,996,903 A 12/1999 Asai et al.
6,053,424 A 4/2000 Gipson et al.
6,102,298 A 8/2000 Bush
6,234,765 B1 5/2001 Deak
6,237,525 B1 5/2001 Kinnunen
6,247,525 B1 6/2001 Smith et al.
6,402,046 B1 6/2002 Loser
6,478,754 B1 11/2002 Babaev
6,530,370 B1 3/2003 Heinonen
6,533,803 B2 3/2003 Babaev
6,543,700 B2 4/2003 Jameson et al.
6,569,099 B1 5/2003 Babaev
6,601,581 B1 8/2003 Babaev
6,623,444 B2 9/2003 Babaev
6,656,506 B1 12/2003 Wu et al.
6,659,365 B2 * 12/2003 Gipson et al. ..... 239/102.2
6,663,554 B2 12/2003 Babaev
6,706,337 B2 3/2004 Hebert
6,720,710 B1 4/2004 Wenzel et al.
6,723,064 B2 4/2004 Babaev
6,730,349 B2 5/2004 Schwartz
6,739,520 B2 5/2004 Ohnishi et al.
6,761,729 B2 7/2004 Babaev
6,767,637 B2 7/2004 Park et al.
6,776,352 B2 * 8/2004 Jameson ..... 239/1
6,811,805 B2 11/2004 Gilliard et al.
6,837,445 B1 1/2005 Tsai
6,845,759 B2 1/2005 Ohnishi et al.
6,883,729 B2 4/2005 Putvinski et al.
6,908,622 B2 6/2005 Barry et al.
6,908,624 B2 6/2005 Hossayniy et al.
6,913,617 B1 7/2005 Riess
6,960,173 B2 11/2005 Babaev
6,964,647 B1 11/2005 Babaev
7,017,282 B2 3/2006 Pyo et al.
7,086,617 B2 8/2006 Fukumoto et al.
2002/0082666 A1 6/2002 Babaev
2002/0103448 A1 8/2002 Babaev
2002/0127346 A1 9/2002 Heber
2002/0138036 A1 9/2002 Babaev
2002/0156400 A1 10/2002 Babaev
2002/0190136 A1 12/2002 Babaev
2003/0098364 A1 5/2003 Jameson
2003/0153961 A1 8/2003 Babaev
2003/0171701 A1 9/2003 Babaev
2003/0199815 A1 * 10/2003 Trombley et al. ..... 604/82
2003/0223886 A1 12/2003 Keilman
2003/0225451 A1 12/2003 Sundar
2003/0229304 A1 12/2003 Babaev
2003/0236560 A1 12/2003 Babaev
2004/0030254 A1 2/2004 Babaev
2004/0039375 A1 2/2004 Miyazawa
2004/0045547 A1 3/2004 Yamamoto et al.
2004/0186384 A1 9/2004 Babaev
2004/0204680 A1 10/2004 Lal et al.
2004/0224001 A1 11/2004 Pacetti et al.
2004/0234748 A1 11/2004 Stenzel
2004/0236399 A1 11/2004 Sundar
2004/0254638 A1 12/2004 Byun
2005/0015024 A1 1/2005 Babaev
2005/0064088 A1 3/2005 Fredrickson
2006/0025716 A1 2/2006 Babaev
2006/0058710 A1 3/2006 Babaev
2007/0016110 A1 1/2007 Babaev
2007/0031611 A1 2/2007 Babaev
2007/0051307 A1 3/2007 Babaev
2007/0088217 A1 4/2007 Babaev
2007/0088245 A1 4/2007 Babaev
2007/0088386 A1 4/2007 Babaev
2007/0185527 A1 8/2007 Babaev
2007/0231346 A1 10/2007 Babaev
2007/0233054 A1 10/2007 Babaev
2007/0239250 A1 10/2007 Babaev
2007/0244528 A1 10/2007 Babaev
2007/0295832 A1 12/2007 Gibson et al.
2008/0006714 A1 1/2008 McNichols et al.

FOREIGN PATENT DOCUMENTS

EP 416106 A4 3/1992
EP 1370321 A1 12/2003
EP 1322275 A4 10/2004
EP 1526825 A1 5/2005
EP 1596940 A1 11/2005
EP 1617910 A1 1/2006
EP 1355696 A4 5/2006
SU 1237261 6/1986
WO 9011135 A1 10/1990
WO 9012655 A1 11/1990
WO 9717933 A1 3/1997
WO 9717933 A1 5/1997
WO 0224150 A3 3/2002
WO 02055131 A3 7/2002
WO 02055150 A3 7/2002
WO 02060525 A3 8/2002
WO 02028350 C1 10/2002
WO 02076547 A1 10/2002
WO 02085456 A1 10/2002
WO 2004014284 B1 7/2004
WO 2004089469 A1 10/2004
WO 2004091722 C1 5/2006
WO 2007002598 A3 1/2007
WO 2007018980 A3 2/2007
WO 2007021427 A3 2/2007
WO 2007046989 A3 4/2007
WO 2007046990 A2 4/2007
WO 2007117800 A2 10/2007
WO 2007117964 A2 10/2007
WO 2007121123 A2 10/2007

* cited by examiner

ECHOING ULTRASOUND ATOMIZATION AND MIXING SYSTEM

BACKGROUND OF THE INVENTION

The present invention relates to an apparatus utilizing ultrasonic waves traveling through a horn and/or resonant structure to atomize, assist in the atomization of, and/or mix fluids passing through the horn and/or resonant structure.

Liquid atomization is a process by which a liquid is separated into small droplets by some force acting on the liquid, such as ultrasound. Exposing a liquid to ultrasound creates vibrations and/or cavitations within the liquid that break it apart into small droplets. U.S. Pat. No. 4,153,201 to Berger et al., U.S. Pat. No. 4,655,393 to Berger, and U.S. Pat. No. 5,516,043 to Manna et al. describe examples of atomization systems utilizing ultrasound to atomize a liquid. These devices possess a tip vibrated by ultrasonic waves passing through the tip. Within the tips are central passages that carry the liquid to be atomized. The liquid within the central passage is driven towards the end of the tip by some force acting upon the liquid. Upon reaching the end of the tip, the liquid to be atomized is expelled from tip. Ultrasonic waves emanating from the front of the tip then collide with the liquid, thereby breaking the liquid apart into small droplets. Thus, the liquid is not atomized until after it leaves the ultrasound tip because only then is the liquid exposed to collisions with ultrasonic waves.

SUMMARY OF THE INVENTION

An ultrasound apparatus capable of mixing and/or atomizing fluids is disclosed. The apparatus comprises a horn having an internal chamber including a back wall, a front wall, and at least one side wall, a radiation surface at the horn's distal end, at least one channel opening into the chamber, and a channel originating in the front wall of the internal chamber and terminating in the radiation surface. Connected to the horn's proximal end, a transducer powered by a generator induces ultrasonic vibrations within the horn. Traveling down the horn from the transducer to the horn's radiation surface, the ultrasonic vibrations induce the release of ultrasonic energy into the fluids to be atomized and/or mixed as they travel through the horn's internal chamber and exit the horn at the radiation surface. As the ultrasonic vibrations travel through the chamber, the fluids within the chamber are agitated and/or begin to cavitate, thereby mixing the fluids. Upon reaching the front wall of the chamber, the ultrasonic vibrations are reflected back into the chamber, like an echo. The ultrasonic vibrations echoing off the front wall pass through the fluid within the chamber a second time, further mixing the fluids.

As with typical pressure driven fluid atomizers, the ultrasound atomization and/or mixing apparatus is capable of utilizing pressure changes within the fluids passing through the apparatus to drive atomization. The fluids to be atomized and/or mixed enter the apparatus through one or multiple channels opening into the internal chamber. The fluids then flow through the chamber and into a channel extending from the chamber's front wall to the radiation surface. If the channel originating in the front wall of the internal chamber is narrower than the chamber, the pressure of the fluid flowing through the channel decreases and the fluid's velocity increases. Because the fluids' kinetic energy is proportional to velocity squared, the kinetic energy of the fluids increases as they flow through the channel. The pressure of the fluids is thus converted to kinetic energy as the fluids flow through the channel. Breaking the attractive forces between the molecules of the fluids, the increased kinetic energy of the fluids causes the fluids to atomize as they exit the horn at the radiation surface.

Fluids passing through a typical pressure driven atomizer are generally only mixed together by the fluids' movement through the atomizer. This can be inefficient and/or result in unequal mixing. Ultrasonic vibrations emanating from the surfaces of vibrating tips may simultaneously atomize and mix fluids, as described in European Patent Application No. 89,907,373.8 (Publication No. 0416106 A1). However, mixing of the fluids is hindered by the simultaneous atomization of the fluids. As the fluids atomize, their volume increases causing the fluids to expand and separate. Thus, as the fluids combine they are simultaneously being driven apart. Ultrasonic atomizing tips may also contain a wide region followed by a narrow region through which the fluids flow, as described in U.S. Pat. Nos. 4,469,974, 4,995,367, 5,025,766, and 6,811,805. Though capable of atomizing and mixing liquids with ultrasonic vibrations emanating from their distal surfaces, these devices have not been configured to fully take advantage of ultrasonic vibrations within the wide regions to mix the fluids to be atomized. Consequently, the amount of mixing produced by such devices primarily results from the fluids' movements through the devices and ultrasound induced atomization.

By agitating and/or inducing cavitations within fluids passing through the internal chamber, ultrasonic energy emanating from various points of the atomization and/or mixing apparatus thoroughly mixes fluids as they pass through the internal chamber. When the proximal end of the horn is secured to an ultrasound transducer, activation of the transducer induces ultrasonic vibrations within the horn. The vibrations can be conceptualized as ultrasonic waves traveling from the proximal end to the distal end of horn. As the ultrasonic vibrations travel down the length of the horn, the horn contracts and expands. However, the entire length of the horn is not expanding and contracting. Instead, the segments of the horn between the nodes of the ultrasonic vibrations (points of minimum deflection or amplitude) are expanding and contracting. The portions of the horn lying exactly on the nodes of the ultrasonic vibrations are not expanding and contracting. Therefore, only the segments of the horn between the nodes are expanding and contracting, while the portions of the horn lying exactly on nodes are not moving. It is as if the ultrasound horn has been physically cut into separate pieces. The pieces of the horn corresponding to nodes of the ultrasonic vibrations are held stationary, while the pieces of the horn corresponding to the regions between nodes are expanding and contracting. If the pieces of the horn corresponding to the regions between nodes were cut up into even smaller pieces, the pieces expanding and contracting the most would be the pieces corresponding to the antinodes of ultrasonic vibrations (points of maximum deflection or amplitude).

The amount of mixing that occurs within the chamber can be adjusted by changing the locations of the chamber's front and back walls with respect to ultrasonic vibrations passing through the horn. Moving forwards and backwards, the back wall of the chamber induces ultrasonic vibrations in the fluids within the chamber. As the back wall moves forward it hits the fluids. Striking the fluids, like a mallet hitting a gong, the back wall induces ultrasonic vibrations that travel through the fluids. The vibrations traveling through the fluids possess the same frequency as the ultrasonic vibrations traveling through horn. The farther forwards and backwards the back wall of the chamber moves, the more forcefully the back wall strikes the fluids within the chamber and the higher the amplitude of the ultrasonic vibrations within the fluids.

When the ultrasonic vibrations traveling through the fluids within the chamber strike the front wall of the chamber, the front wall compresses forwards. The front wall then rebounds backwards, striking the fluids within the chamber, and thereby creates an echo of the ultrasonic vibrations that struck the front wall. If the front wall of the chamber is struck by an antinode of the ultrasonic vibrations traveling through chamber, then the front wall will move as far forward and backward as is possible. Consequently, the front wall will strike the fluids within the chamber more forcefully and thus generate an echo with the largest possible amplitude. If, however, the ultrasonic vibrations passing through the chamber strike the front wall of the chamber at a node, then the front wall will not be forced forward because there is no movement at a node. Consequently, an ultrasonic vibration striking the front wall at a node will not produce an echo.

Positioning the front and back walls of the chamber such that at least one point on both, preferably their centers, lie approximately on antinodes of the ultrasonic vibrations passing through the chamber maximizes the amount of mixing occurring within the chamber. Moving the back wall of the chamber away from an antinode and towards a node decreases the amount of mixing induced by ultrasonic vibrations emanating from the back wall. Likewise, moving the front wall of the chamber away from an antinode and towards a node decreases the amount of mixing induced by ultrasonic vibrations echoing off the front wall. Therefore, positioning the front and back walls of the chamber such that center of both the front and back wall lie approximately on nodes of the ultrasonic vibrations passing through the chamber minimizes the amount of mixing within the chamber.

The amount of mixing that occurs within the chamber can also be adjusted by controlling the volume of the fluids within the chamber. Ultrasonic vibrations within the chamber may cause atomization of the fluids, especially liquids. As the fluids atomize, their volumes increase which may cause the fluids to separate. However, if the fluids completely fill the chamber, then there is no room in the chamber to accommodate an increase in the volume of the fluids. Consequently, the amount of atomization occurring within the chamber when the chamber is completely filled with the fluids will be decreased and the amount of mixing increased.

The ultrasonic echoing properties of the chamber may also be enhanced by including an ultrasonic lens within the front wall of the chamber. Ultrasonic vibrations striking the lens within the front wall of the chamber are directed to reflect back into the chamber in a specific manner depending upon the configuration of the lens. For instance, a lens within the front wall of the chamber may contain a concave portion. Ultrasonic vibrations striking the concave portion of the lens would be reflected towards the side walls. Upon impacting the side walls, the reflected ultrasonic vibrations would be reflected again, and would thus echo throughout the chamber. If the concaved portion or portions within the lens form an overall parabolic configuration in at least two dimensions, then the ultrasonic vibrations echoing off the lens and/or the energy they carry may be focused towards the focus of the parabola.

In combination or in the alternative, the lens within the front wall of the chamber may also contain a convex portion. Again, ultrasonic vibrations emitted from the chamber's back wall striking the lens within the front wall would be directed to reflect back into and echo throughout the chamber in a specific manner. However, instead of being directed towards a focal point as with a concave portion, the ultrasonic vibrations echoing off the convex portion are reflected in a dispersed manner.

In combination or in the alternative, the back wall of the chamber may also contain an ultrasonic lens possessing concave and/or convex portions. Such portions within the back wall lens of the chamber function similarly to their front wall lens equivalents, except that in addition to directing and/or focusing echoing ultrasonic vibrations, they also direct and/or focus the ultrasonic vibrations as they are emitted into the chamber.

The amount of mixing occurring within the internal chamber may be controlled by adjusting, the amplitude of the ultrasonic vibrations traveling down the length of the horn. Increasing the amplitude of the ultrasonic vibrations increases the degree to which the fluids within the chamber are agitated and/or cavitated. If the horn is ultrasonically vibrated in resonance by a piezoelectric transducer driven by an electrical signal supplied by a generator, then increasing the voltage of the electrical signal will increase the amplitude of the ultrasonic vibrations traveling down the horn.

As with typical pressure driven fluid atomizers, the ultrasound atomization apparatus utilizes pressure changes within the fluid to create the kinetic energy that drives atomization. Unfortunately, pressure driven fluid atomization can be adversely impacted by changes in environmental conditions. Most notably, a change in the pressure of the environment into which the atomized fluid is to be sprayed may decrease the level of atomization and/or distort the spray pattern. As a fluid passes through a pressure driven fluid atomizer, it is pushed backwards by the pressure of the environment. Thus, the net pressure acting on the fluid is the difference of the pressure pushing the fluid through the atomizer and the pressure of the environment. It is the net pressure of the fluid that is converted to kinetic energy. Thus, as the environmental pressure increases, the net pressure decreases, causing a reduction in the kinetic energy of the fluid exiting the horn. An increase in environmental pressure, therefore, reduces the level of fluid atomization.

A counteracting increase in the kinetic energy of the fluid may be induced from the ultrasonic vibrations emanating from the radiation surface. Like the back wall of the internal chamber, the radiation surface is also moving forwards and backwards when ultrasonic vibrations travel down the length of the horn. Consequently, as the radiation surface moves forward it strikes the fluids exiting the horn and the surrounding air. Striking the exiting fluids and surrounding air, the radiation surface emits, or induces, vibrations within the exiting fluids. As such, the kinetic energy of the exiting fluids increases. The increased kinetic energy further atomizes the fluids exiting at the radiation surface, thereby counteracting a decrease in atomization caused by changing environmental conditions.

The increased kinetic energy imparted on the fluids by the movement of the radiation surface can be controlled by adjusting the amplitude of the ultrasonic vibrations traveling down the length of the horn. Increasing the amplitude of the ultrasonic vibrations increases the amount of kinetic energy imparted on the fluids as they exit at the radiation surface.

As with increases in environmental pressure, decreases in environmental pressure may adversely impact the atomized spray. Because the net pressure acting on the fluids is converted to kinetic energy and the net pressure acting on the fluids is the difference of the pressure pushing the fluids through the atomizer and the pressure of the environment, decreasing the environmental pressure increases the kinetic energy of the fluids exiting a pressure driven atomizer. Thus, as the environmental pressure decreases, the exiting velocity of the fluids increases. Exiting the atomizer at a higher velocity, the atomized fluid droplets move farther away from the atomizer, thereby widening the spray pattern. Changing the spray pattern may lead to undesirable consequences. For instance, widening the spray pattern may direct the atomized fluids away from their intended target and/or towards unintended targets. Thus, a decrease in environmental pressure may result in a detrimental un-focusing of the atomized spray.

Adjusting the amplitude of the ultrasonic waves traveling down the length of the horn may be useful in focusing the atomized spray produced at the radiation surface. Creating a focused spray may be accomplished by utilizing the ultrasonic vibrations emanating from the radiation surface to confine and direct the spray pattern. Ultrasonic vibrations emanating from the radiation surface may direct and confine the vast majority of the atomized spray produced within the outer boundaries of the radiation surface. The level of confinement obtained by the ultrasonic vibrations emanating from the radiation surface depends upon the amplitude of the ultrasonic vibrations traveling down the horn. As such, increasing the amplitude of the ultrasonic vibrations passing through the horn may narrow the width of the spray pattern produced; thereby focusing the spray. For instance, if the spray is fanning too wide, increasing the amplitude of the ultrasonic vibrations may narrow the spray pattern. Conversely, if the spray is too narrow, then decreasing the amplitude of the ultrasonic vibrations may widen the spray pattern.

Changing the geometric conformation of the radiation surface may also alter the shape of the spray pattern. Producing a roughly column-like spray pattern may be accomplished by utilizing a radiation surface with a planar face. Generating a spray pattern with a width smaller than the width of the horn may be accomplished by utilizing a tapered radiation surface. Further focusing of the spray may be accomplished by utilizing a concave radiation surface. In such a configuration, ultrasonic waves emanating from the concave radiation surface may focus the spray through the focus of the radiation surface. If it is desirable to focus, or concentrate, the spray produced towards the inner boundaries of the radiation surface, but not towards a specific point, then utilizing a radiation surface with slanted portions facing the central axis of the horn may be desirable. Ultrasonic waves emanating from the slanted portions of the radiation surface may direct the atomized spray inwards, towards the central axis. There may, of course, be instances where a focused spray is not desirable. For instance, it may be desirable to quickly apply an atomized liquid to a large surface area. In such instances, utilizing a convex radiation surface may produce a spray pattern with a width wider than that of the horn. The radiation surface utilized may possess any combination of the above mentioned configurations such as, but not limited to, an outer concave portion encircling an inner convex portion and/or an outer planar portion encompassing an inner conical portion. Inducing resonating vibrations within the horn facilitates the production of the spray patterns described above, but may not be necessary.

It should be noted and appreciated that other benefits and/or mechanisms of operation, in addition to those listed, may be elicited by devices in accordance with the present invention. The mechanisms of operation presented herein are strictly theoretical and are not meant in any way to limit the scope this disclosure and/or the accompanying claims.

DETAILED DESCRIPTION OF THE INVENTION

Preferred embodiments of the ultrasound atomization and/or mixing apparatus are illustrated throughout the figures and described in detail below. Those skilled in the art will immediately understand the advantages for mixing and/or atomizing material provided by the atomization and/or mixing apparatus upon review.

Figure 1A:
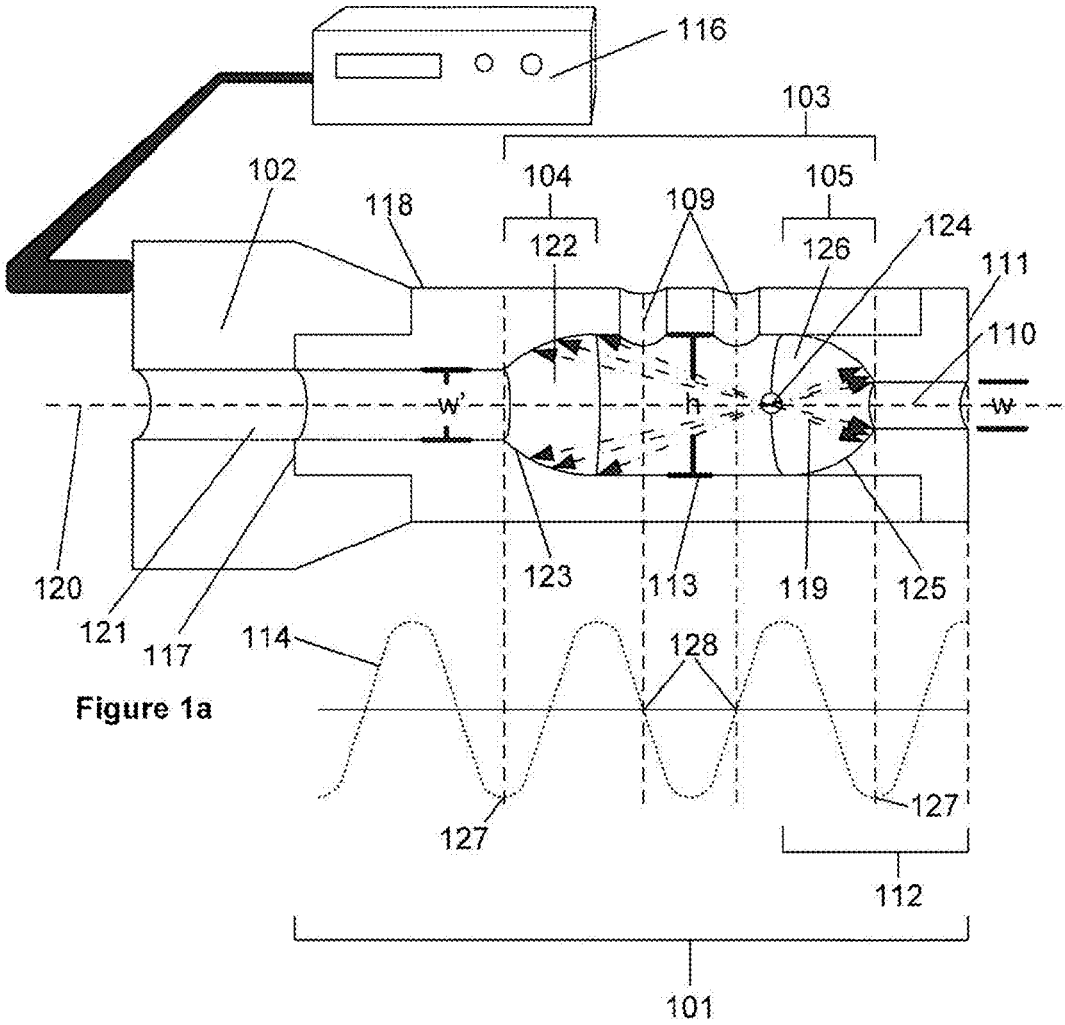
FIGS. 1*a* and 1*b* illustrate cross-sectional views of an embodiment of the ultrasound atomization and/or mixing apparatus.
Figure 1B:
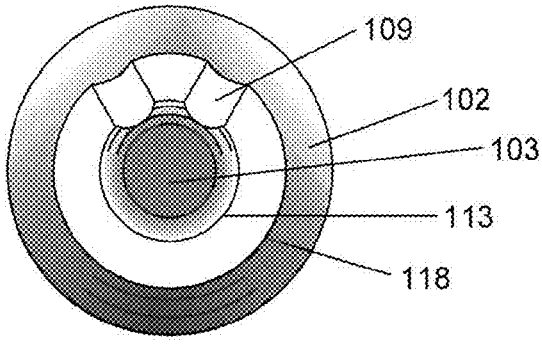

FIGS. 1*a* and 1*b* illustrate an embodiment of the ultrasound atomization and/or mixing apparatus comprising a horn 101 and an ultrasound transducer 102 attached to the proximal surface 117 of horn 101 powered by generator 116. As ultrasound transducers and generators are well known in the art they need not be described in detail herein. Ultrasound horn 101 comprises a proximal surface 117, a radiation surface 111 opposite proximal surface 117, and at least one radial surface 118 extending between proximal surface 117 and radiation surface 111. Within horn 101 is an internal chamber 103 containing a back wall 104, a front wall 105, at least one side wall 113 extending between back wall 104 and front wall 105, and ultrasonic lenses 122 and 126 within back wall 104 and front wall 105, respectively. As to induce vibrations within horn 101, ultrasound transducer 102 may be mechanically coupled to proximal surface 117. Mechanically coupling horn 101 to transducer 102 may be achieved by mechanically attaching (for example, securing with a threaded connection), adhesively attaching, and/or welding horn 101 to transducer 102. Other means of mechanically coupling horn 101 and ultrasound transducer 102, readily recognizable to persons of ordinary skill in the art, may be used in combination with or in the alternative to the previously enumerated means. Alternatively, horn 101 and transducer 102 may be a single piece. When transducer 102 is mechanically coupled to horn 101, driving ultrasound transducer 102 with an electrical signal supplied from generator 116 induces ultrasonic vibrations 114 within horn 101. If transducer 102 is a piezoelectric transducer, then the amplitude of the ultrasonic vibrations 114 traveling down tie length of horn 101 may be increased by increasing the voltage of the electrical signal driving transducer 102.

As the ultrasonic vibrations 114 travel down the length of horn 101, back wall 104 oscillates back-and-forth. The back-and-forth movement of back wall 104 induces the release of ultrasonic vibrations from lens 122 into the fluids inside chamber 103. Positioning back wall 104 such that at least one point on lens 122 lies approximately on an antinode 127 of the ultrasonic vibrations 114 passing through horn 101 may maximize the amount and/or amplitude of the ultrasonic vibrations emitted into the fluids in chamber 103. Preferably, the center of lens 122 lies approximately on an antinode 127 of the ultrasonic vibrations 114. The ultrasonic vibrations 119 emanating from lens 122, represented by arrows, travel towards the front of chamber 103. When the ultrasonic vibrations 119 strike lens 126 within front wall 105 they echo off lens 126, and thus are reflected back into chamber 103. The reflected ultrasonic vibrations 119 then travel towards back wall 104. Traveling towards front wall 105 and then echoing back towards back wall 104, ultrasonic vibrations 119 travel back and forth through chamber 103 in an undisturbed echoing pattern. As to maximize the echoing of ultrasound vibrations 119 off lens 126, it may be desirable to position front wall 105 such that at least one point on lens 126 lies on an antinode 127 of the ultrasonic vibrations 114. Preferably, the center of lens 126 lies approximately on an antinode 127 of the ultrasonic vibrations 114.

The specific lenses illustrated in FIG. 1*a* contain concave portions. If the concave portion 123 of lens 122 within back wall 104 form an overall parabolic configuration in at least two dimensions, then the ultrasonic vibrations 119 depicted by arrows emanating from the lens 122 travel in an undisturbed pattern of convergence towards the parabola's focus 124. As the ultrasonic vibrations 119 converge at focus 124, the ultrasonic energy carried by ultrasound vibrations 119 may become focused at focus 124. After converging at focus 124, the ultrasonic vibrations 119 diverge and continue towards front wall 105. After striking the concave portion 125 of lens 126 within front wall 105, ultrasonic vibrations 119 are reflected back into chamber 103. If concave portion 125 form an overall parabolic configuration in at least two dimensions, the ultrasonic vibrations 119 echoing backing into chamber 103 may travel in an undisturbed pattern of convergence towards the parabola's focus. The ultrasonic energy carried by the echoing vibrations and/or the energy they carry may become focused at the focus 124 of the parabola formed by the concave portion 125. Converging as they travel towards front wall 105 and then again as they echo back towards back wall 104, ultrasonic vibrations 119 travel back and forth through chamber 103 in an undisturbed, converging echoing pattern.

In the embodiment illustrated in FIG. 1*a* the parabolas formed by concave portions 123 and 125 have a common focus 124. In the alternative, the parabolas may have different foci. However, by sharing a common focus 124, the ultrasonic vibrations 119 emanating and/or echoing off the parabolas and/or the energy the vibrations carry may become focused at focus 124. The fluids passing through chamber 103 are therefore exposed to the greatest concentration of the ultrasonic agitation, cavitation, and/or energy at focus 124. Consequently, the ultrasonically induced mixing of the fluids is greatest at focus 124. Positioning focus 124, or any other focus of a parabola formed by the concave portions 123 and/or 125, at point downstream of the entry of at least two fluids into chamber 103 may maximize the mixing of the fluids entering chamber 103 upstream of the focus.

The fluids to be atomized and/or mixed enter chamber 103 of the embodiment depicted in FIGS. 1*a* and 1*b* through at least one channel 109 originating in radial surface 118 and opening into chamber 103. Preferably, channel 109 encompasses a node 128 of the ultrasonic vibrations 114 traveling down the length of the horn 101 and/or emanating from lens 122. In the alternative or in combination, channel 109 may originate in radial surface 118 and open at back wall 104 into chamber 103. Upon exiting channel 109, the fluids flow through chamber 103. The fluids then exit chamber 103 through channel 110, originating within front wall 105 and terminating within radiation surface 111. As the fluids to be atomized pass through channel 110, the pressure of the fluids decreases while their velocity increases. Thus, as the fluids flow through channel 110, the pressure acting on the fluids is converted to kinetic energy. If the fluids gain sufficient kinetic energy as they pass through channel 110, then the attractive forces between the molecules of the fluids may be broken, causing the fluids to atomize as they exit channel 110 at radiation surface 111. If the fluids passing through horn 101 are to be atomized by the kinetic energy gained from their passage through channel 110, then the maximum height (h) of chamber 103 should be larger than maximum width (w) of channel 110. Preferably, the maximum height of chamber 103 should be approximately 200 times larger than the maximum width of channel 110 or greater.

It is preferable if at least one point on radiation surface 111 lies approximately on an antinode of the ultrasonic vibrations 114 passing through horn 101.

As to simplify manufacturing, ultrasound horn 101 may further comprise cap 112 attached to its distal end. Cap 112 may be mechanically attached (for example, secured with a threaded connector), adhesively attached, and/or welded to the distal end of horn 101. Other means of attaching cap 112 to horn 101, readily recognizable to persons of ordinary skill in the art, may be used in combination with or in the alternative to the previously enumerated means. Comprising front wall 105, channel 110, and radiation surface 111, a removable cap 112 permits the level of fluid atomization and/or the spray pattern produced to be adjusted depending on need and/or circumstances. For instance, the width of channel 110 may need to be adjusted to produce the desired level of atomization with different fluids. The geometrical configuration of the radiation surface may also need to be changed as to create the appropriate spray pattern for different applications. Attaching cap 112 to the present invention at approximately a nodal point of the ultrasonic vibrations 114 passing through horn 101 may help prevent the separation of cap 112 from horn 101 during operation.

It is important to note that fluids of different temperatures may be delivered into chamber 103 as to improve the atomization of the fluids exiting channel 110. This may also change the spray volume, the quality of the spray, and/or expedite the drying process of the fluids sprayed.

Alternative embodiments of an ultrasound horn 101 in accordance with the present invention may possess a single channel 109 opening within side wall 113 of chamber 103. If multiple channels 109 are utilized, they may be aligned along the central axis 120 of horn 101, as depicted in FIG. 1*a*. Alternatively or in combination, channels 109 may be located on different platans, as depicted in FIG. 1*a*, and/or the same platan, as depicted in FIG. 1*b*.

Alternatively or in combination, the fluids to be atomized may enter chamber 103 through a channel 121 originating in proximal surface 117 and opening within back wall 104, as depicted in FIG. 1*a*. If the fluids passing through horn 101 are to be atomized by the kinetic energy gained from their passage through channel 110, then the maximum width (w') of channel 121 should be smaller than the maximum height of chamber 103. Preferably, the maximum height of chamber 103 should be approximately twenty times larger than the maximum width of channel 121.

A single channel may be used to deliver the fluids to be mixed and/or atomized into chamber 103. When horn 101 includes multiple channels opening into chamber 103, atomization of the fluids may be improved by delivering a gas into chamber 103 through at least one of the channels.

Horn 101 and chamber 103 may be cylindrical, as depicted in FIG. 1. Horn 101 and chamber 103 may also be constructed in other shapes and the shape of chamber 103 need not correspond to the shape of horn 101.

Figure 2:
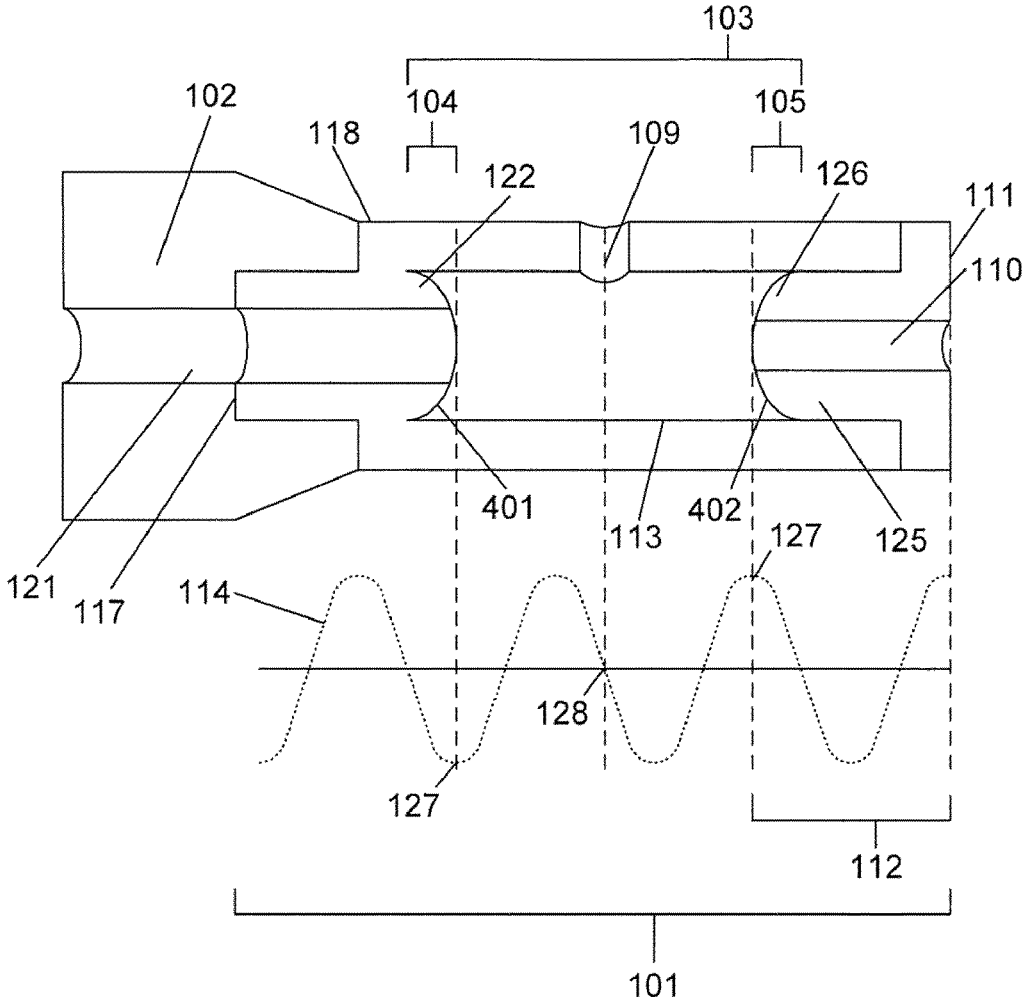
FIG. 2 illustrates a cross-sectional view of an alternative embodiment of the ultrasound atomizing and/or mixing apparatus wherein the back wall and front wall contain lenses with convex portions.

FIG. 2 illustrates a cross-sectional view of an alternative embodiment of the ultrasound atomizing and/or mixing apparatus wherein lens 122 within back wall 104 and lens 126 within front wall 105 contain convex portions 401 and 402, respectively. Ultrasonic vibrations emanating from convex portion 401 of lens 122 travel in an undisturbed dispersed reflecting pattern towards front wall 105 in the following manner: The ultrasonic vibrations are first directed towards side wall 113 at varying angles of trajectory. The ultrasonic vibrations then reflect off side wall 113. Depending upon the angle at which the ultrasonic vibrations strike side wall 113, they may be reflected through central axis 120 and travel in an undisturbed reflecting pattern towards front wall 105. However, if the vibrations emanating from back wall 104 strike side wall 113 at a sufficiently shallow angle, they may be reflected directly towards front wall 105, without passing through central axis 120. Likewise, when the ultrasonic vibrations strike lens 126 within front wall 105, they echo back into chamber 103 in an undisturbed dispersed reflecting pattern towards back wall 104. As such, some of the ultrasonic vibrations echoing off lens 126 may pass through central axis 120 after striking side wall 113. Some of the echoing ultrasonic vibrations may travel directly towards back wall 104 after striking side wall 113 without passing through central axis 120. Failing to converge at a single point, or along a single axis, as they travel to front wall 105 and then again as they echo back towards back wall 104, the ultrasonic vibrations travel back and forth through chamber 103 in an undisturbed, dispersed echoing pattern. Consequently, the ultrasonically induced mixing of the fluids within chamber 103 may be dispersed throughout chamber 103.

It should be appreciated that the configuration of the chamber's front wall lens need not match the configuration of the chamber's back wall lens. Furthermore, the lenses within the front and/or back walls of the chamber may comprise any combination of the above mentioned configurations such as, but not limited to, an outer concave portion encircling an inner convex portion.

As the fluids passing through horn 101 exit channel 110, they may be atomized into a spray. In the alternative or in combination, the fluids exiting channel 110 may be atomized into a spray by the ultrasonic vibrations emanating from radiation surface 111. Regardless of whether fluids are atomized as they exit channel 10 and/or by the vibrations emanating from radiation surface 111, the vibrations emanating from the radiation may direct and/or confine the spray produced.

Figure 3A:
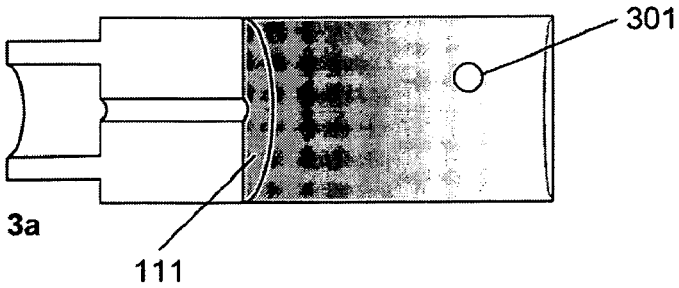
FIGS. 3*a* through 3*e* illustrate alternative embodiments of the radiation surface.
Figure 3B:
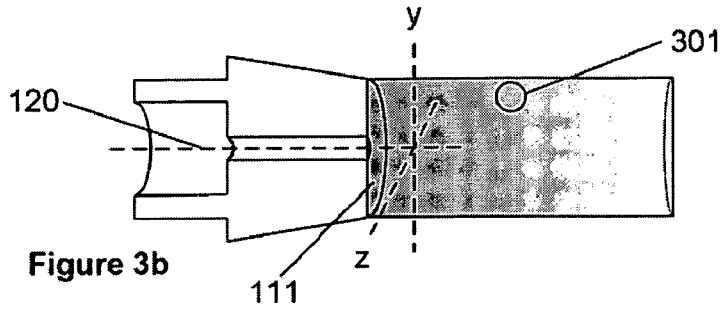

The manner in which ultrasonic vibrations emanating from the radiation surface direct the spray of fluid ejected from channel 110 depends largely upon the conformation of radiation surface 11. FIGS. 3*a*-3*e* illustrate alternative embodiments of the radiation surface. FIGS. 3*a* and 3*b* depict radiation surfaces 111 comprising a planar face producing a roughly column-like spray pattern. Radiation surface 111 may be tapered such that it is narrower than the width of the horn in at least one dimension oriented orthogonal to the central axis 120 of the horn, as depicted FIG. 3*b*. Ultrasonic vibrations emanating from the radiation surfaces 111 depicted in FIGS. 3*a* and 3*b* may direct and confine the vast majority of spray 301 ejected from channel 110 to the outer boundaries of the radiation surfaces 111. Consequently, the majority of spray 301 emitted from channel 110 in FIGS. 3*a* and 3*b* is initially confined to the geometric boundaries of the respective radiation surfaces.

Figure 3C:
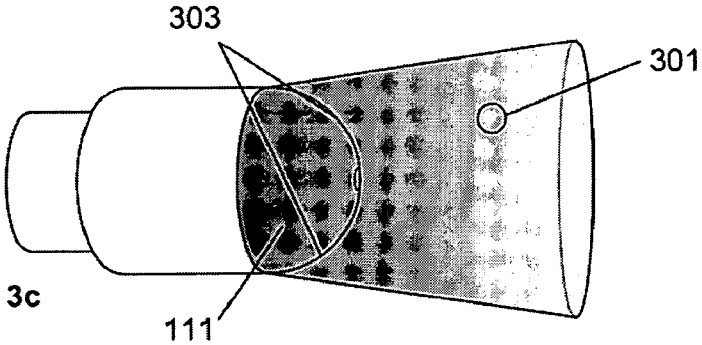
Figure 3D:
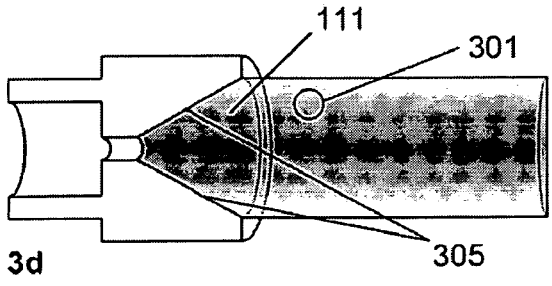
Figure 3E:
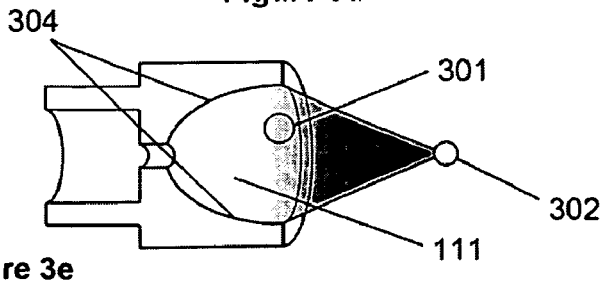

The ultrasonic vibrations emitted from the convex portion 303 of the radiation surface 111 depicted in FIG. 3*c* directs spray 301 radially and longitudinally away from radiation surface 111. Conversely, the ultrasonic vibrations emanating from the concave portion 304 of the radiation surface 111 depicted in FIG. 3*e* focuses spray 301 through focus 302. Maximizing the focusing of spray 301 towards focus 302 may be accomplished by constructing radiation surface 111 such that focus 302 is the focus of an overall parabolic configuration formed in at least two dimensions by concave portion 304. The radiation surface III may also possess a conical portion 305 as depicted in FIG. 3*d*. Ultrasonic vibrations emanating from the conical portion 305 direct the atomized spray 301 inwards. The radiation surface may possess any combination of the above mentioned configurations such as, but not limited to, an outer concave portion encircling an inner convex portion and/or an outer planar portion encompassing an inner conical portion.

Regardless of the configuration of the radiation surface, adjusting the amplitude of the ultrasonic vibrations traveling down the length of the horn may be useful in focusing the atomized spray produced. The level of confinement obtained by the ultrasonic vibrations emanating from the radiation surface and/or the ultrasonic energy the vibrations carry depends upon the amplitude of the ultrasonic vibrations traveling down horn. As such, increasing the amplitude of the ultrasonic vibrations may narrow the width of the spray pattern produced; thereby focusing the spray produced. For instance, if the fluid spray exceeds the geometric bounds of the radiation surface, i.e. is fanning too wide, increasing the amplitude of the ultrasonic vibrations may narrow the spray. Conversely, if the spray is too narrow, then decreasing the amplitude of the ultrasonic vibrations may widen the spray. If the horn is vibrated in resonance frequency by a piezoelectric transducer attached to its proximal end, increasing the amplitude of the ultrasonic vibrations traveling down the length of the horn may be accomplished by increasing the voltage of the electrical signal driving the transducer.

The horn may be capable of vibrating in resonance at a frequency of approximately 16 kHz or greater. The ultrasonic vibrations traveling down the horn may have an amplitude of approximately 1 micron or greater. It is preferred that the horn be capable of vibrating in resonance at a frequency between approximately 20 kHz and approximately 200 kHz. It is recommended that the horn be capable of vibrating in resonance at a frequency of approximately 30 kHz.

The signal driving the ultrasound transducer may be a sinusoidal wave, square wave, triangular wave, trapezoidal wave, or any combination thereof.

It should be appreciated that elements described with singular articles such as "a", "an", and/or "the" and/or otherwise described singularly may be used in plurality. It should also be appreciated that elements described in plurality may be used singularly.

Although specific embodiments of apparatuses and methods have been illustrated and described herein, it will be appreciated by those of ordinary skill in the art that any arrangement, combination, and/or sequence that is calculated to achieve the same purpose may be substituted for the specific embodiments shown. It is to be understood that the above description is intended to be illustrative and not restrictive. Combinations of the above embodiments and other embodiments as well as combinations and sequences of the above methods and other methods of use will be apparent to individuals possessing skill in the art upon review of the present disclosure.

The scope of the claimed apparatus and methods should be determined with reference to the appended claims, along with the full scope of equivalents to which such claims are entitled.

I claim:

1. An apparatus characterized by:

a. an ultrasound horn having a proximal surface;

b. the ultrasound horn also having a radiation surface opposite the proximal surface;

c. at least one radial surface extending along the ultrasound horn between the proximal surface and the radiation surface;

d. an internal chamber within the ultrasound horn containing:

i. a back wall;

ii. a front wall;
iii. at least one side wall extending between the back wall and the front wall;
iv. an ultrasonic lens within the front wall; and
v. an ultrasonic lens within the back wall;

e. at least one channel originating in a surface other than the radiation surface and opening into the internal chamber;
f. a channel originating in the front wall of the internal chamber and terminating in the radiation surface; and
g. being capable of vibrating in resonance at a frequency of approximately 16 kHz or greater.

2. The apparatus according to claim 1 further characterized by at least one point on the lens within the back wall of the chamber lying approximately on an anti-node of the vibrations of the apparatus.

3. The apparatus according to claim 1 further characterized by at least one point on the radiation surface lying approximately on an anti-node of the vibrations of the apparatus.

4. The apparatus according to claim 1 further characterized by at least one point on the lens within the front wall of the chamber lying approximately on a anti-node of the vibrations of the apparatus.

5. The apparatus according to claim 1 further characterized by the channel opening into the chamber originating in a radial surface and opening into a side wall of the internal chamber approximately on a node of the vibrations.

6. The apparatus according to claim 1 further characterized by a transducer attached to the proximal surface.

7. The apparatus according to claim 6 further characterized by a generator to drive the transducer.

8. An apparatus comprising a. an ultrasound horn having a proximal surface;
b. the ultrasound horn also having a radiation surface opposite the proximal surface;
c. at least one radial surface extending along the ultrasound horn between the proximal surface and the radiation surface;
d. an internal chamber within the ultrasound horn containing:
i. a back wall;
ii. a front wall;
iii. at least one side wall extending between the back wall and the front wall;
iv. an ultrasonic lens within the front wall; and
v. an ultrasonic lens within the back wall;
e. at least one channel originating in a surface other than the radiation surface and opening into the internal chamber; and
f. a channel originating in the front wall of the internal chamber and terminating in the radiation surface.

9. The apparatus according to claim 8 characterized by the maximum height of the internal chamber being larger than the maximum width of the channel originating in the front wall of the internal chamber.

10. The apparatus according to claim 8 characterized by the maximum height of the internal chamber being approximately 200 times larger than the maximum width of the channel originating in the front wall of the internal chamber or greater.

11. The apparatus according to claim 8 characterized by the channel opening into the chamber originating in the proximal surface and opening into the back wall of the internal chamber and the maximum height of the internal chamber being larger than the maximum width of the channel.

12. The apparatus according to claim 8 characterized by the channel opening into the chamber originating in the proximal surface and opening into the back wall of the internal chamber and the maximum height of the internal chamber being approximately 20 times larger than the maximum width of the channel or greater.

13. The apparatus according to claim 8 further comprising an ultrasonic lens within the back wall of the chamber.

14. The apparatus according to claim 13 further comprising one or a plurality of concave portions within the lens within the back wall that form an overall parabolic configuration in at least two dimensions.

15. The apparatus according to claim 13 further comprising at least one convex portion within the lens within the back wall.

16. The apparatus according to claim 8 further comprising an ultrasonic lens within the front wall of the chamber.

17. The apparatus according to claim 16 further comprising one or a plurality of concave portions within the lens within the front wall that form an overall parabolic configuration in at least two dimensions.

18. The apparatus according to claim 16 further comprising at least one convex portion within the lens within the front wall.

19. The apparatus according to claim 8 further comprising at least one planar portion within the radiation surface.

20. The apparatus according to claim 8 further comprising a central axis extending from the proximal surface to the radiation surface and a region of the radiation surface narrower than the width of the apparatus in at least one dimension oriented orthogonal to the central axis.

21. The apparatus according to claim 8 further comprising at least one concave portion within the radiation surface.

22. The apparatus according to claim 8 further comprising at least one convex portion within the radiation surface.

23. The apparatus according to claim 8 further comprising at least one conical portion within the radiation surface.

24. The apparatus according to claim 8 further comprising a transducer attached to the proximal surface capable of vibrating the apparatus according to claim 8 in resonance at a frequency of approximately 16 kHz or greater.

25. The apparatus according to claim 24 further comprising a generator to drive the transducer.

* * * * *